United States Patent [19]

Weeks

[11] Patent Number: 4,993,092

[45] Date of Patent: Feb. 19, 1991

[54] PATIENT CARRIER COVER AND METHOD

[76] Inventor: David B. Weeks, 233 Felch St., Holland, Mich. 49424

[21] Appl. No.: 434,314

[22] Filed: Nov. 13, 1989

[51] Int. Cl.[5] ..... A61G 1/01; A47C 31/00; A47G 9/00

[52] U.S. Cl. ..... 5/508; 5/82 R; 5/484; 150/154

[58] Field of Search ..... 5/82 R, 508, 482, 487, 5/484; 150/154; 190/26; 128/870

[56] References Cited

U.S. PATENT DOCUMENTS 3,290,703 12/1960 Worrall ..... 5/484

3,956,782 5/1976 Morrison ..... 5/484

*Primary Examiner*—Alexander Grosz

*Attorney, Agent, or Firm*—Price, Heneveld, Cooper, DeWitt & Litton

[57] ABSTRACT

A fluid impermeable envelope for covering a patient carrier or backboard to protect it from contact with body fluids. The envelope completely encloses the patient carrier and has apertures therein aligned with the handholds in the patient carrier. A second embodiment of the envelope has continuous upper and lower surfaces with bag-like projections on either side of each handhold in the patient carrier. The upper bag-like extension can be telescoped into the lower bag-like extension to form mittens continuous with the envelope surface for gripping the patient carrier. Resilient safety belt guides are also provided for attachment to opposite sides of a covered patient carrier and for providing guides for safety belts about a person on the covered patient carrier.

11 Claims, 3 Drawing Sheets

PATIENT CARRIER COVER AND METHOD

BACKGROUND OF THE INVENTION

The present invention relates to emergency devices for handling stricken patients. When a patient is injured, suffers from trauma, stroke, heart attack etc., the patient has to be moved by an emergency team. To facilitate such movement, the patient is typically placed on a patient carrier, such as a backboard, or a Stokes' basket or the like. These patient carriers provide rigid support for the neck and spinal column and help to prevent accidental misalignment in the event the back or neck is broken.

Patients often eliminate when they are in a stricken condition. They may have open wounds and may bleed on the patient carrier. These fluids are a potential source of contamination for the patient carrier. Similarly, patients injured in chemical accidents may have chemicals on their person and clothing which can contaminate the patient carrier. In some cases, the chemicals could conceivably react with the material of the patient carrier, generate heat and further injure the patient.

While such contaminants can be cleaned off the patient carrier if sufficient care is used, there is often not enough time to exercise such care. As a result, several patients may be conveyed in a single night on a patient carrier which has not been cleaned between uses, other than superficially.

SUMMARY OF THE INVENTION

The present invention comprises a fluid impermeable polymeric cover which is slipped over a patient carrier and which includes suitable handhold openings which match the openings in the handholds for the patient carrier. Preferably, the polymeric material is a fiber reinforced polymeric laminate. Also in a most preferred embodiment, the handhold openings are fitted with polymeric mittens which prevent exposure of the patient carrier even in the handhold area. The method of using the cover to protect a patient carrier is also disclosed.

DETAILED DESCRIPTION OF THE PREFERRED EMBODIMENTS

Figure 1:
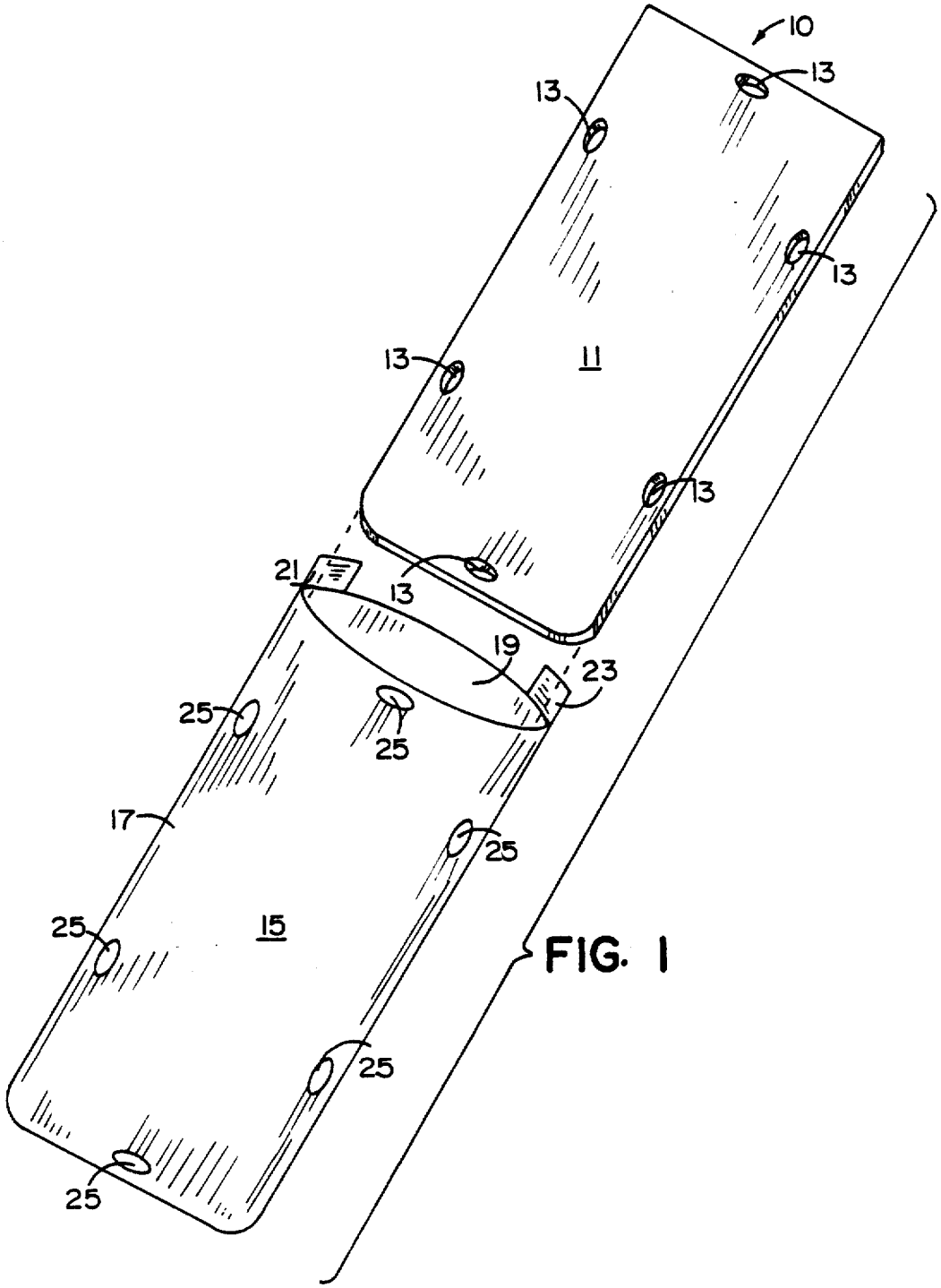
FIG. 1 is a perspective view of a patient carrier ready for covering by a protective cover of the present invention.

Referring to FIG. 1, a patient carrier board, indicated generally by the number 10, is shown. The patient carrier board has a substantially flat surface 11 for supporting the patient Handholds 13 are provided about the edge and at one end of the patient carrier board. The board is normally used, as shown in FIG. 1, without a cover and, as discussed previously, is subject to contamination by body fluids and/or chemicals if the board is used to carry a victim from a chemical accident.

In order to protect the board 11 from contamination, a suitable fluid impermeable cover 15 is provided into which the board 11 can be inserted.

The fluid impermeable cover 15 can be made of polymeric materials such as polyethylene and polyester. The preferred material for the cover is a composite film made of a laminate of polyurethane film and a fiber reinforced polymeric film sold under the trademark "Tyvek" by E. I. DuPont de Nemours & Co. An even more preferred material for harsh chemical resistance is a laminate of Tyvek and Saranex. Saranex is a product of Dow Chemical Company.

The cover 15 is preferably made by heat sealing or weld sealing an upper layer 17 and a lower layer 19 of polymeric material about three sides to form a cover similar to an envelope which is closed on three sides and open at one end for insertion of the patient carrier board 11. The open end of the cover 15 has flaps 21 and 23 which can be folded over to completely enclose the patient carrier board 11 within the cover 15 Cut out handholds 25 are provided in alignment with the handholds 13 in the patient carrier board 11. The top surface 17 of the protective cover can be folded over the end of the patient carrier board 11 and under a portion of the bottom layer of the cover 19 where it is then held in place by tabs 21 and 23.

Figure 2:
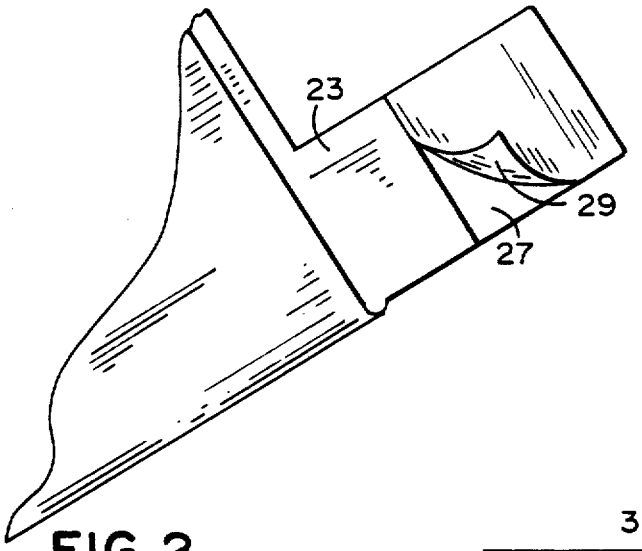
FIG. 2 is a partial perspective view showing a tab having an adhesive coating partly exposed by a release film which is pulled up.
Figure 3:
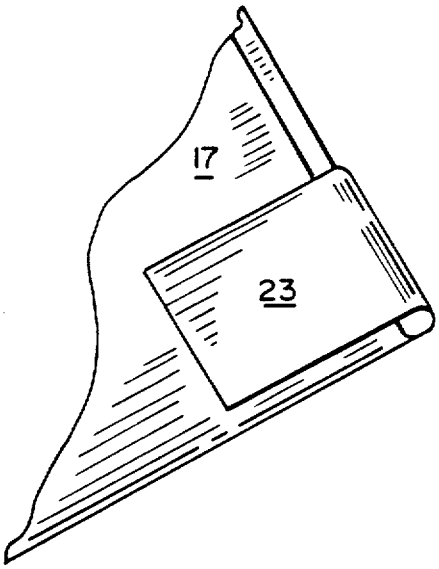
FIG. 3 is a partial perspective view showing the tab of FIG. 8 adhered to the surface of the protective cover.

Referring to FIGS. 2 and 3, the tab 23 is shown having a layer of conventional adhesive material 27 on the underside thereof. A layer of release paper 29, such as a silicone coated or treated paper, protects the adhesive 27 until it is ready for use. As shown in FIG. 3, the tab 23 can be folded over and attached to the surface 17 of the envelope enclosing the patient carrier board.

Figure 4:
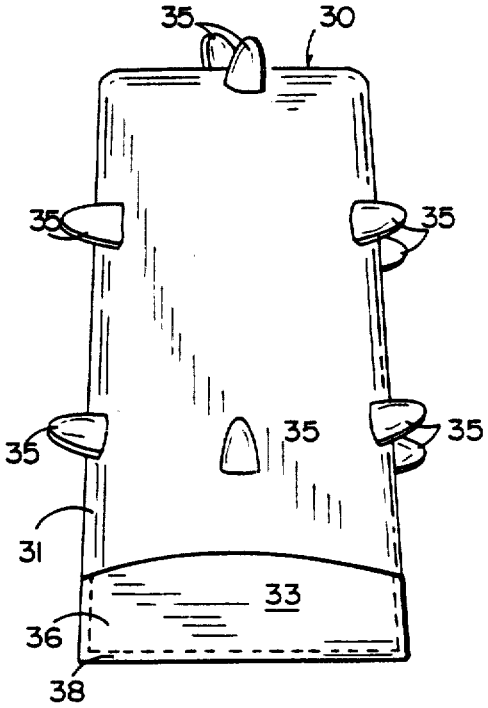
FIG. 4 is a perspective view of a second embodiment of the patient carrier cover having a protective flap.

Referring to FIG. 4, it can be seen in this construction that the patient carrier board is completely protected from contact with any body fluid and chemical. The envelope has a central body portion made up of an upper surface 31 and a lower surface 33. A bag-like projection 35 is provided on both sides of the envelope for each handhold of the patient carrier board. One surface of the board has an attached or continuous flap 36 which has an adhesive layer 38 about the edge. After the patient carrier board is inserted in the cover, the flap can be folded over and sealed to the surface completely enclosing the board protecting it from contamination or contact with chemical materials. It is clearly within the scope of the present invention to use hook and loop-type fastening strips. However, since the covers are intended to be disposable, it is less costly to use adhesive.

Figure 5:
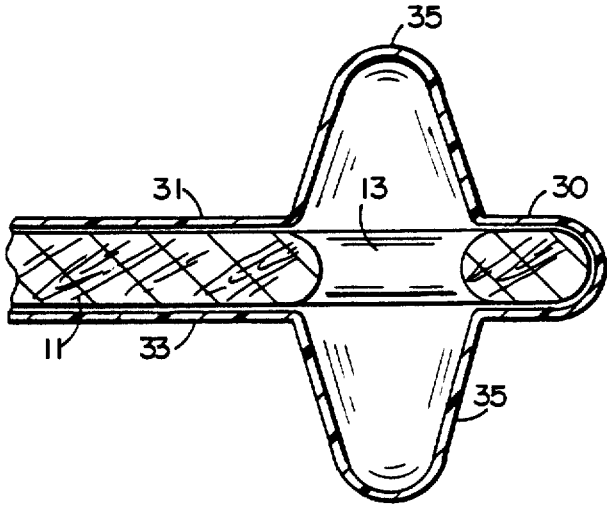
FIG. 5 is a partial sectional view showing a patient carrier board in a cover with bag-like projections shown on either side of the handhold in the patient carrier board.
Figure 6:
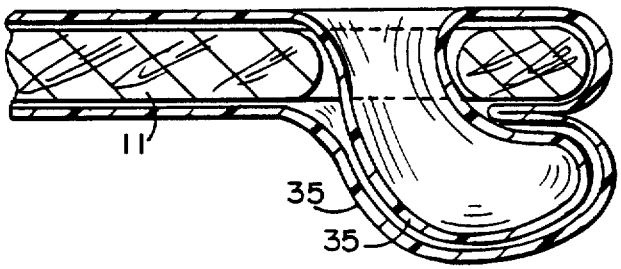
FIG. 6 is a partial sectional view similar to FIG. 5 showing the bag-like top projection telescoped into the lower bag-like projection to form a mitten into which the hand can be placed when grasping the handhold of the carrier board.

Referring to FIGS. 5 and 6, a portion of the envelope 30 can be seen with a portion of a patient carrier board 11 in place. The bag-like projections 35 can be seen on either side of the handhold 13 In FIG. 6, the upper bag-like projection has been telescoped into the lower bag-like projection to form a mitten-like cover for the hand completely protecting the patient carrier board from any possible contamination.

When a patient is being carried on a patient carrier board, it is customary practice to use security belts to hold the patient in place. The security belts protect the patient from movement which might aggravate an injury and also enable the persons carrying the patient to be able to manipulate the patient through doorways and down stairways and the like, without fear that the patient will move on the patient carrier board When the patient carrier protecting envelope of the present invention is used to cover the patient carrier, it is difficult to use security belts about the patient. The guides normally provided on the patient carrier are covered by the envelope.

Figure 7:
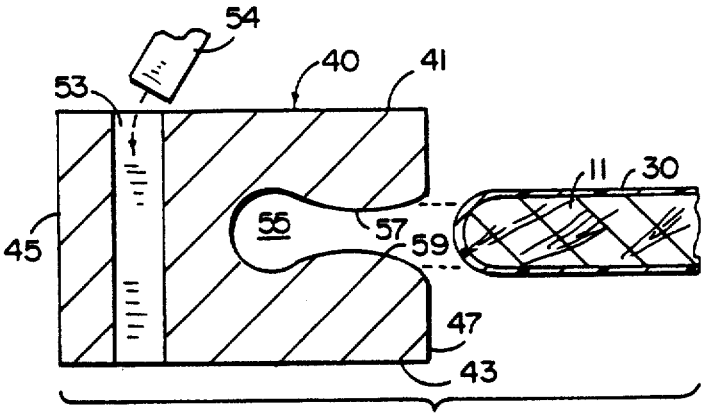
FIG. 7 is a side sectional view of a safety belt guide showing the edge of a patient carrier board aligned for insertion into the guide.
Figure 8:
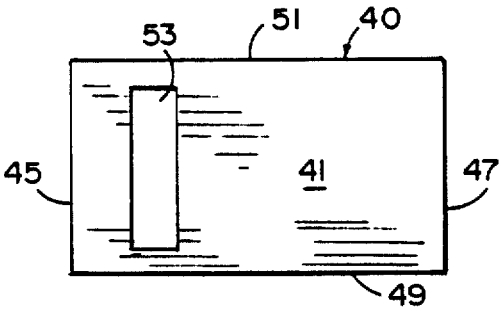
FIG. 8 is a top plan view of a safety belt guide.

In order to overcome the above-mentioned problem and referring to FIGS. 7 and 8, a resilient clamp indicated generally by the number 40 is provided The clamp 40 is made of a block of resilient material having a top surface 41, a bottom surface 43, a left surface 45, a right surface 47, a front surface 49 and a back surface 51. A substantially rectangular aperture 53 extends from the top surface 41 to the bottom surface 43 adjacent the left side 45 of the block of resilient material The rectangular aperture provides a guide for a safety belt 54 to pass through. A pair of belt guides 40 are used for each safety belt with one being opposite the other on the sides of the covered patient carrier A large recessed opening 55 is provided through the resilient block from the front surface 49 to the rear surface 51 with the recess opening in from the right side surface 47. The end of the recess 55 is enlarged to receive the edge of the patient carrier 11 while opposing faces 57 and 59 form clamping faces for securing the resilient safety belt guide 40 to the edge of the patient carrier 11 which is covered by the envelope. The safety belt guide 40 can be made of any resilient material such as any one of the synthetic rubbers. It is important that the belt guide be compatible with body fluids and preferably be made of a material resistant to chemical contamination or reaction It is also within the scope of the present invention to enclose the safety belt guide 40 in a layer of material such as polyethylene to protect it from reaction with harsh chemicals in the event of a chemical accident.

The above description has been directed to the use of the protective cover with a back board type patient carrier. The cover can also be used with a Stokes basket and with a stretcher or other means for carrying a patient.

From the above description it can be seen that a protective envelope is provided for protecting a patient carrier from contamination with bodily fluids and chemicals. The protective covers are disposable so that a fresh patient carrier can be used for each patient to protect them from possible contamination by any infectious disease and to protect them from harsh chemicals at the same time the patient carrier is also protected and is ready for use.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege are claimed are defined as follows:

1. A cover for a backboard having a flat surface with spaced handholds about the periphery thereof comprising:

a flexible fluid impermeable cover having an upper and lower surface joined along three sides, each of said upper and lower surfaces having apertures therein in substantial alignment with said handholds in said backboard to enable said handholds to be gripped.

2. A cover for a backboard as set forth in claim 1, wherein bag-like extending portions are provided for each aperture on said upper and lower surface of said flexible cover to form mittens for grasping said handholds when opposed bag-like extensions are telescoped together.

3. A cover for a backboard as set forth in claim 1, including at least one tab extending from a surface of said cover, means on said tab for securing the open side of said cover for enclosing said backboard.

4. A cover for a backboard as set forth in claim 3, wherein said tabs have a coating of an adhesive material for holding said tabs in position.

5. A cover for a backboard as set forth in claim 3, wherein said tabs have a hook and loop type surface for attachment to a hook and loop type surface on said flexible cover.

6. A cover for a backboard as set forth in claim 1, wherein said cover is made of a fluid impermeable polymeric material.

7. A cover for a backboard as set forth in claim 1, wherein said cover is made of a laminate of polymeric material and a fiber reinforced polymeric material.

8. A patient carrier cover comprising:

a fluid impermeable flexible envelope for receiving a patient carrier, said envelope having cooperating apertures in its upper and lower surfaces for grasping handhold portions of said said patient carrier.

9. A patient carrier cover as set forth in claim 8, wherein upper and lower flexible bag-like extending portions are provided for said cooperating apertures on each side of said envelope, so that one bag-like extending portion can telescope into said other bag-like extending portion to form a mitten for grasping said patient carrier.

10. A patient carrier cover as set forth in claim 8, wherein said cover is made of a fluid impermeable polymeric material.

11. A patient carrier cover as set forth in claim 8, wherein said cover is made of a polymeric material and a fiber reinforced polymeric material.

* * * * *